United States Patent [19]

Aoyama et al.

[11] 4,150,646

[45] Apr. 24, 1979

[54] EGR CONTROL SYSTEM FOR INTERNAL COMBUSTION ENGINES

[75] Inventors: Syunichi Aoyama, Yokohama; Yasuo Nakajima, Yokosuka; Yoshimasa Hayashi, Yokohama, all of Japan

[73] Assignee: Nissan Motor Company, Limited, Japan

[21] Appl. No.: 834,422

[22] Filed: Sep. 19, 1977

[30] Foreign Application Priority Data

Sep. 21, 1976 [JP] Japan ..... 51/113307

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,973,535 | 8/1976 | Sugihara et al. | 123/119 A |
| 3,978,834 | 9/1976 | Arnaud et al. | 123/119 A |
| 3,996,906 | 12/1976 | Bubniar et al. | 123/119 A |
| 4,005,689 | 2/1977 | Barnard | 123/119 A |
| 4,027,638 | 6/1977 | Moriya et al. | 123/119 A |
| 4,033,308 | 7/1977 | Hayashi et al. | 123/119 A |
| 4,040,401 | 8/1977 | Marsee | 123/119 A |
| 4,057,043 | 11/1977 | Harada | 123/119 A |
| 4,061,265 | 12/1977 | Kitamura | 123/119 A |
| 4,080,941 | 3/1978 | Bertrand | 123/119 A |

FOREIGN PATENT DOCUMENTS

| | | | |
|---|---|---|---|
| 2225852 | 1/1973 | Fed. Rep. of Germany | 123/119 A |
| 2531213 | 2/1977 | Fed. Rep. of Germany | 123/119 A |

*Primary Examiner*—Wendell E. Burns

*Attorney, Agent, or Firm*—Robert E. Burns; Emmanuel J. Lobato; Bruce L. Adams

[57] ABSTRACT

An engine equipped with an electronically controlled fuel injection system is provided with an EGR control system which accurately regulates the EGR rate in accordance with a vacuum signal produced at a venturi formed in the intake passageway of the engine, under low and medium load engine operating conditions. However, under high speed and high load engine operating conditions, a part of intake air is bypassed through a bypass passage connecting the upstream and downstream sides of the venturi in order to prevent increase of the flow resistance of the intake air.

25 Claims, 4 Drawing Figures

EGR CONTROL SYSTEM FOR INTERNAL COMBUSTION ENGINES

BACKGROUND OF THE INVENTION

This invention relates to an EGR (Exhaust Gas Recirculation) control system for controllably recirculate a portion of exhaust gases of an internal combustion engine back to the combustion chamber of the engine.

It is well known in the art that a part of the exhaust gases of an internal combustion engine is recirculated back to the combustion chamber of the engine in order to suppress the maximum temperature of the combustion taken place in the combustion chamber to reduce the emission level of nitrogen oxides (NOx) which are generated during the combustion in the combustion chamber. By virtue of this exhaust gas recirculation, the NOx emission level has thus effectively been lowered. However, the recirculated exhaust gas considerably affects the combustion in the combustion chamber and the driveability of engine and therefore its amount is desired to be strictly controlled in response to engine operating conditions.

In this regard, the following EGR control system has been proposed by the same applicant as the present application: An EGR control valve is closeably disposed in an EGR passageway connecting an intake passageway and an exhaust passageway of an internal combustion engine. The EGR control valve is operated to control the exhaust gas recirculated back to the combustion chamber of the engine, which is accomplished by varying the exhaust gas pressure in the EGR passageway upstream of the EGR control valve in accordance with the variations of a venturi vacuum in the intake passageway. By this EGR control system, the recirculated exhaust gas flow is prevented from being affected by the variation of exhaust gas pressure in the EGR passageway. As a result, the recirculated exhaust gas flow can be controlled only in accordance with the venturi vacuum which is highly reliable as a function of the flow amount of the intake air conducted through the intake passageway into the combustion chamber. This EGR control system makes it possible to effectively decrease NOx emission level without causing the degradation of the engine driveability.

However, the above-mentioned EGR control system has encountered the following problems when used with engines which do not have a carburetor having a venturi, such as engines equipped with an electronically controlled fuel injection system in place of a carburetor: since it is difficult to obtain a highly reliable vacuum signal which acts to vary the exhaust gas pressure in the EGR passageway upstream of the EGR control valve, an accurate EGR control has failed, degrading engine driveability, fuel consumption and the ability of exhaust gas purifying devices. Of course, it may be considered to provide a venturi in the intake passageway of such a type of engines and to take out the vacuum signal from the venturi. However, with this arrangement, the flow resistance of intake air through the intake passageway is unavoidably increased to decrease engine power output particularly under high load and high speed engine operating conditions.

SUMMARY OF THE INVENTION

It is the prime object of the present invention is to provide an improved EGR control system for an internal combustion engine without a carburetor having a venturi, by which the emission level of NOx is effectively lowered without causing deterioration of engine performance characteristics.

Another object of the present invention is to provide an improved EGR control system for an internal combustion engine without a carburetor having a venturi, by which the emission level of NOx is effectively lowered without invitation of lowering engine power output under a high power output engine operating condition.

A still further object of the present invention is to provide an improved EGR control system for an internal combustion engine, by which the flow resistance of intake air is not increased even under a high power output engine operating condition through the intake passageway is provided with a venturi from which a vacuum signal for EGR control valve is taken out, and through which the intake air is inducted into the combustion chamber of the engine.

A still further object of the present invention is to provide an improved EGR control system for an internal combustion engine, by which EGR rate (the volume rate of recirculated exhaust gases relative to intake air) can be accurately regulated in accordance with the flow amount of the intake air under low and medium load engine operating condition though the engine is not equipped with a carburetor having a venturi, but such a control is not carried out under high load and high speed engine operating condition in order to obtain a high power output.

Other objects, features and advantages of the EGR control system according to the present invention will be more apparent from the following description taken in conjunction with the accompanying drawings.

DESCRIPTION OF THE PREFERRED EMBODIMENTS

Figures 1, 2:
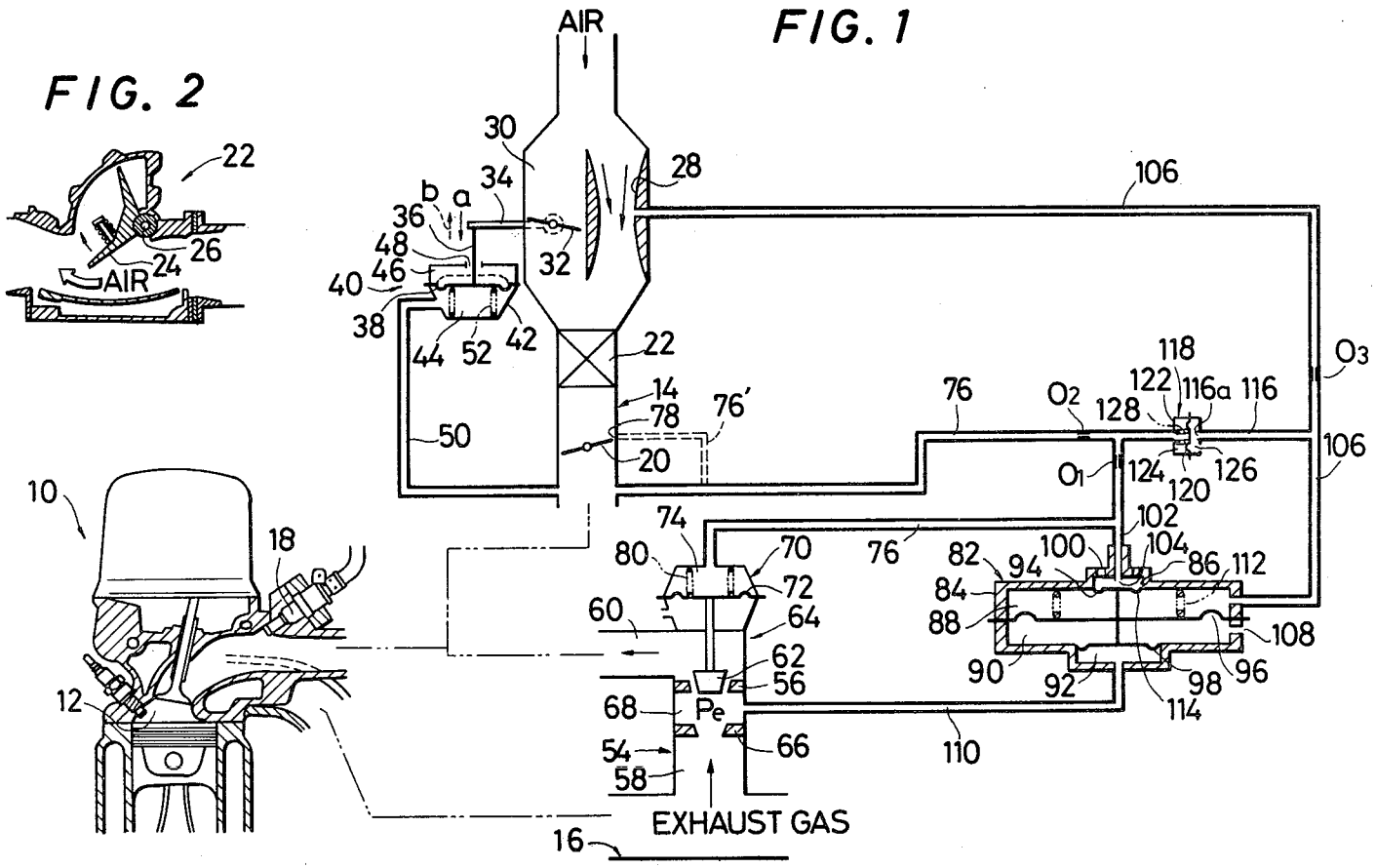
FIG. 1 is a schematic illustration of a preferred embodiment of an EGR control system according to the present invention in combination with an engine equipped with an electronically controlled fuel injection system.
FIG. 2 is a cross-sectional view of an air flow meter used in the EGR control system of FIG. 1.

Referring now to FIGS. 1 and 2 of the drawings, a preferred embodiment of an exhaust gas recirculation (EGR) control system according to the present invention is shown as combined with an internal combustion engine including an engine proper 10 in which a combustion chamber 12 or combustion chambers are, as usual, formed. The combustion chamber 12 is communicable with the atmosphere through an intake passageway 14 forming part of the intake system of the engine. The combustion chamber 12 is further communicable with the atmosphere through an exhaust gas passageway 16 forming part of the exhaust system of the engine. Reference numeral 18 denotes a fuel injector forming part of an electronically controlled fuel injection system (no numeral) which is arranged to supply the combustion chamber with a suitable amount of fuel in accordance with various engine operating parameters. This system is known in the art and accordingly its detail explanation is omitted for the purpose of simplicity of description.

A throttle valve 20 is rotatably disposed in the intake passageway 14 upstream of the fuel injector 18 to control the amount of intake air inducted into the combustion chamber. Disposed upstream of the throttle valve 20 is an air flow meter 22 or sensor for detecting the flow amount of the intake air inducted through the intake passageway 14. As shown in detail in FIG. 2, the airflow meter 22 is composed of a movable measuring plate 24 which is pivotally mounted on a shaft 26. The measuring plate 24 is arranged to be opened by the air stream against the force of a spring (not shown). The position of the measuring plate is sensed, for example, by means of a potentiometer (not shown).

The intake passageway 14 is enlarged in its portion upstream of the airflow meter 22 to form therein a venturi 28 and bypass passage 30. A butterfly valve 32 is rotatably disposed in the bypass passage 30 and operatively connected through a level 34 and a rod 36 to a diaphragm member 38 forming part of a diaphragm actuator 40. The diaphragm member 38 separates the interior of a casing 42 into a vacuum chamber 44 and an atmospheric chamber 46 which communicates with the atmosphere through an opening 48. The vacuum chamber communicates through a passage 50 or a pipe with the intake passageway downstream of the throttle valve 20 so that the diaphragm member 38 receives the intake vacuum or suction vacuum downstream of the throttle valve 20. As seen, a spring 52 is disposed in the vacuum chamber 44 to urge the diaphragm member 38 in the direction to move upwardly. In this case, the butterfly valve 32 is arranged to be close when the intake vacuum downstream of the throttle valve 20 is above a predetermined level such as 150 mmHg, while to be open when the same intake vacuum is below the predetermined level.

The EGR control system is composed of an EGR passageway 54 providing communication between the exhaust gas passageway 16 and the intake passageway 14 downstream of the throttle valve 20 for recirculating or conducting engine exhaust gases into the intake passageway 14. The EGR passageway 54 is formed therein with a partition member 56 which divide the EGR passageway 54 into an upstream portion 58 connected to the exhaust gas passageway 16 and a downstream portion 60 connected to the intake passageway 14. The partition member 56 has an opening (no numeral) therethrough and serves as a valve seat of a valve head 62 forming part of an EGR control valve assembly 64. The EGR passageway 54 is formed at its upstream portion with another partition member 66 which is provided with an opening (no numeral) or an orifice therethrough. The partition member 66 defines a chamber 68 between it and the partition member 56. The partition member 66 may not be used because the EGR passageway 54 itself serves as a restriction for the flow of the exhaust gases.

The EGR control valve assembly 64 includes a diaphragm unit 70 having a diaphragm member 72 which is securely connected to the valve head 62. The diaphragm member 72 defines a fluid chamber 74 which communicates through a passage 76 or a conduit with the intake passage 14 downstream of the throttle valve 20 to receive the intake vacuum in the intake passageway downstream of the throttle valve 20. The fluid chamber 74 may communicate with the intake passageway 14 through a passage 76' indicated in phantom. The passage 76' opens adjacent the edge of the throttle valve 20 through a hole 78 which is located just upstream side of the uppermost portion of the peripheral edge of the throttle valve at its fully closed position. A spring 80 is provided to normally urge the diaphragm 72 in a direction to cause the valve head 62 to close the opening formed through the partition member 56.

A pressure controlling valve assembly 82 or control means is provided to control the vacuum for operating the EGR control valve 64. The valve assembly 82 comprises a housing 84 having therein four chambers 86, 88, 90 and 92, and three flexible diaphragms 94, 96 and 98. The diaphragm 94 separates the chambers 86 and 88 from each other. The diaphragm 96 separates the chambers 88 and 90 from each other. The diaphragm 98 separates the chambers 90 and 92 from each other. The chamber 86 communicates with the atmosphere through openings 100 and with the passage 76 through a passage 102 and an inlet port 104. The chamber 88 communicates with the venturi 28 through a passage 106. The chamber 90 is communicated through a hole 108 with the atmosphere. The chamber 90 may not be of the shape of a chamber. The chamber 92 communicates with the chamber 68 of the EGR passageway 54 through a passage 110. The diaphragm 96 has a working or pressure acting surface area larger than that of each of the diaphragms 94 and 98. The diaphragms 94, 96 and 98 are fixedly connected to each other, for example, by means of a rod (no numeral) so that they are operated as one body. A spring 112 is provided to integrally urge the diaphragms 94, 96 and 98 in a direction opposed by the atmospheric pressure in the chamber 90. An orifice $O_1$ is formed in the passage 76 on the intake passageway side of the junction to which the passage 102 is connected. A control valve 114 is secured to the diaphragm 94 and movable relative to the port 104 to control the flow of atmospheric air bled through the port 104 into the passage 102.

A leak or relief passage 116 is connected at its one end to the passage 76 on the intake passageway side of the orifice $O_1$, and the other end thereof to the passage 106. Disposed in the relief passage 116 is a leak or relief valve 118 which is composed of a diaphragm or a diaphragm valve member 120. The diaphragm 120 separates the interior of a casing 122 into a vacuum chamber 124 which communicates with the passage 76 and an atmospheric chamber 126 which is communicated with the atmosphere and with the passage 106 through the relief passage 116. A spring 128 is disposed in the vacuum chamber 124 to normally urge the diaphragm 120 in the direction to contact to and close the open end **116*a* of the relief passage 116 or an open end portion connecting to the relief passage 116. The end portion 116*a* is secured to a portion of the casing 122. This relief valve 118 is constructed and arranged to open the open end 116*a* of the passage 116 to bleed the atmospheric air through the passage 116 into the passage 106 when the vacuum applied to the diaphragm 120 exceeds a predetermined level such as 120 mmHg. As seen, an orifice $O_2$ is disposed in the passage 76 on the intake passageway side of the junction to which the passage 116 is connected. Additionally, an orifice $O_3$ is disposed in the passage 106 on the venturi side of the junction to which the relief passage 116** is connected.

The operation of the thus arranged EGR control system will be discussed hereinafter.

Under a low and medium load (for example, at an engine torque less than 6 Kg.m) engine operating condition in which the opening degree of the throttle valve 20 is relatively small to flow a relatively small amount of the intake air in the intake passageway 14, a relatively strong intake vacuum is applied to the diaphragm member 38 to compress the spring 52 and consequently the rod 36 is pulled in a direction of a solid arrow a to put the butterfly valve 32 into its closed position as shown in FIG. 1. Hence, the intake air is inducted into the combustion chamber 12 of the engine only through the venturi 28. As a result, the venturi produces a venturi vacuum which is accuretely proportional to the flow amount of the intake air.

Under such an engine operating condition, when the venturi vacuum is increased, the diaphragms 94, 96 and 98 are integrally moved so that the valve 114 reduces the degree of opening of the port 104 to reduce the flow of atmospheric air bled into the passage 102 and accordingly the degree of dilution of the suction vacuum conducted into the chamber 74 is reduced. As a result, the degree of opening of the EGR control valve 64 is increased to increase the amount of exhaust gases recirculated into the combustion chamber 12 of the engine. This reduces the pressure $P_e$ in the chamber 68 and therefore in the chamber 92 of the valve assembly 82. The decrease in the pressure $P_e$ moves the diaphragms 94, 96 and 98 integrally to increase the degree of opening of the control valve 114 relative to the port 104 to increase the flow of atmospheric air bled into the passage 102. As a result, the dilution of the suction vacuum by the atmospheric air is increased to reduce the degree of opening of the EGR control valve 64 to increase the pressure $P_e$ in the chamber 68.

On the contrary, when the venturi vacuum is decreased, the degree of dilution of the suction vacuum conducted into the chamber 74 is increased and accordingly the degree of opening of the EGR control valve 64 is decreased to decrease the amount of exhaust gases recirculated into the combustion chamber 12 of the engine. This increases the pressure $P_e$ and accordingly the pressure in the chamber 92 of the valve assembly 82. As a result, the dilution of the suction vacuum by the atmospheric air is decreased to increase the degree of the opening of the EGR control valve 64 to reduce the pressure $P_e$ in the chamber 28.

By the repetition of such operations or such feedback controls, the pressure $P_e$ and the degree of opening of the EGR control valve 64 are converged respectively to values in which the pressure $P_e$ is balanced with the venturi vacuum to increase and reduce the recirculated exhaust gas flow accurately in accordance with the increases and decreases in the venturi vacuum.

When the pressure $P_e$ in the chamber 68 is vaired regardless of the venturi vacuum by variations in the suction vacuum, the EGR control valve 64 is operated to cancel the variations in the pressure $P_e$ by the pressure controlling valve assembly 56. In this instance, when the pressure $P_e$ is a negative pressure and the negative pressure is increased, the diaphragms 94, 96 and 98 are integrally moved to increase the degree of opening of the control valve 114 relative to the port 104. Hence, the degree of opening of the EGR control valve 64 is reduced similarly as mentioned above to reduce the influence of the suction vacuum on the pressure $P_e$ to restore same to an initial value to prevent the recirculated exhaust gas flow from being varied irrespective of the venturi vacuum. It will be appreciated from the foregoing that the pressure $P_e$ is controlled to a predetermined level and therefore the recirculated exhaust gas flow is varied only as a function of the venturi vacuum generated at the venturi formed in the intake passageway. Thus, under low and medium load engine operating conditions, EGR rate (the volume rate of the recirculated exhaust gases relative to the intake air) is maintained constant in accordance with the variation of the venturi vacuum at the venturi formed in the intake passageway to effectively decrease the emission level of NOx without causing degradation of the engine driveability.

Under a high load (for example, at an engine torque more than 6 Kg.m) and high speed (for example, at an engine speed more than 2090 rpm) engine operating condition in which the opening degree of the throttle valve 20 is relatively large to flow a relatively large amount of the intake air in the intake passageway 14, the intake vacuum applied to the diaphragm member 38 is considerably weak and consequently the diaphragm member 38 is moved upwardly to a position indicated by a dotted line by the action of the spring 52. Then, the rod 36 is moved in the direction of a dotted arrow b to rotate the butterfly valve 32 clockwise in the drawing to open the valve 32. Accordingly, the intake air is inducted into the combustion chamber 12 through both the bypass passage 30 and the venturi 28 and consequently the flow resistance of the intake air is decreased as compared with the case in which the intake air is inducted only through the venturi 28. As a result, the engine power output is not prevented from being lowered due to increased flow resistance of intake air even during high load and high speed engine operations.

When the butterfly valve 32 is thus opened, the venturi vacuum at the venturi 28 is decreased to an extent that the venturi vacuum is not proportional to the flow amount of the intake air inducted into the combustion chamber 12. Accordingly, the EGR rate is decreased as compared with that under low and medium load engine operating conditions. However, this is desirable in consideration of the fact that it is required during high load engine operation to decrease the EGR rate to maintain a necessary engine power output characteristics.

Under a low load (for example, at an engine torque less than 3 Kg.m) and high speed engine operating condition where the NOx emission level is relatively low, both the venturi vacuum generated at the venturi 28 and the intake vacuum downstream of the throttle valve 20 increase. Consequently, the composed vacuum or the sum of the intake vacuum downstream of the throttle valve 20 and the suction vacuum applied to the chamber 74 of the diaphragm unit 70 is increased over the predetermined level and applied to the diaphragm 120 of the relief valve 118 to move it in the direction to separate from the open end 116*a* of the passage 116 against the bias of the spring 128. The atmospheric air then bleeds into the passage 106 leading to the chamber 88 of the valve assembly 82 and consequently the venturi vacuum conducted into the chamber 88 is weakened to increase the opening degree of the control valve 114 relative to the port 104. As a result, the suction vacuum conducted into the chamber 74 of the diaphragm unit 78 is weakened to a level and accordingly the composed vacuum applied on the diaphragm 120 of the relief valve 118 is decreased. The diaphragm 120 is thus moved toward the open end 116*a* of the passage 92 to decrease the opening degree of the diaphragm 120 relative to the open end 116*a* of the passage 116. By this action of the relief valve 118, the venturi vacuum in the chamber 88 of the valve assembly 82 is increased, but it again increases the suction vacuum in the passage 102 to increase the opening degree of the diaphragm 120 to the open end 116*a*. Therefore, the diaphragm 120 of the relief valve 118 is balanced to maintain a suitable bleed amount of air into the passage 106 and the chamber 88 of the valve assembly 82.

Thus, the increase of the recirculated gas flow is suppressed under low load and high speed engine operation condition, and the EGR rate is decreased with increased amount of intake air passing through the intake passageway 14 after the air bleed through the relief valve 118 begins.

Figure 3:
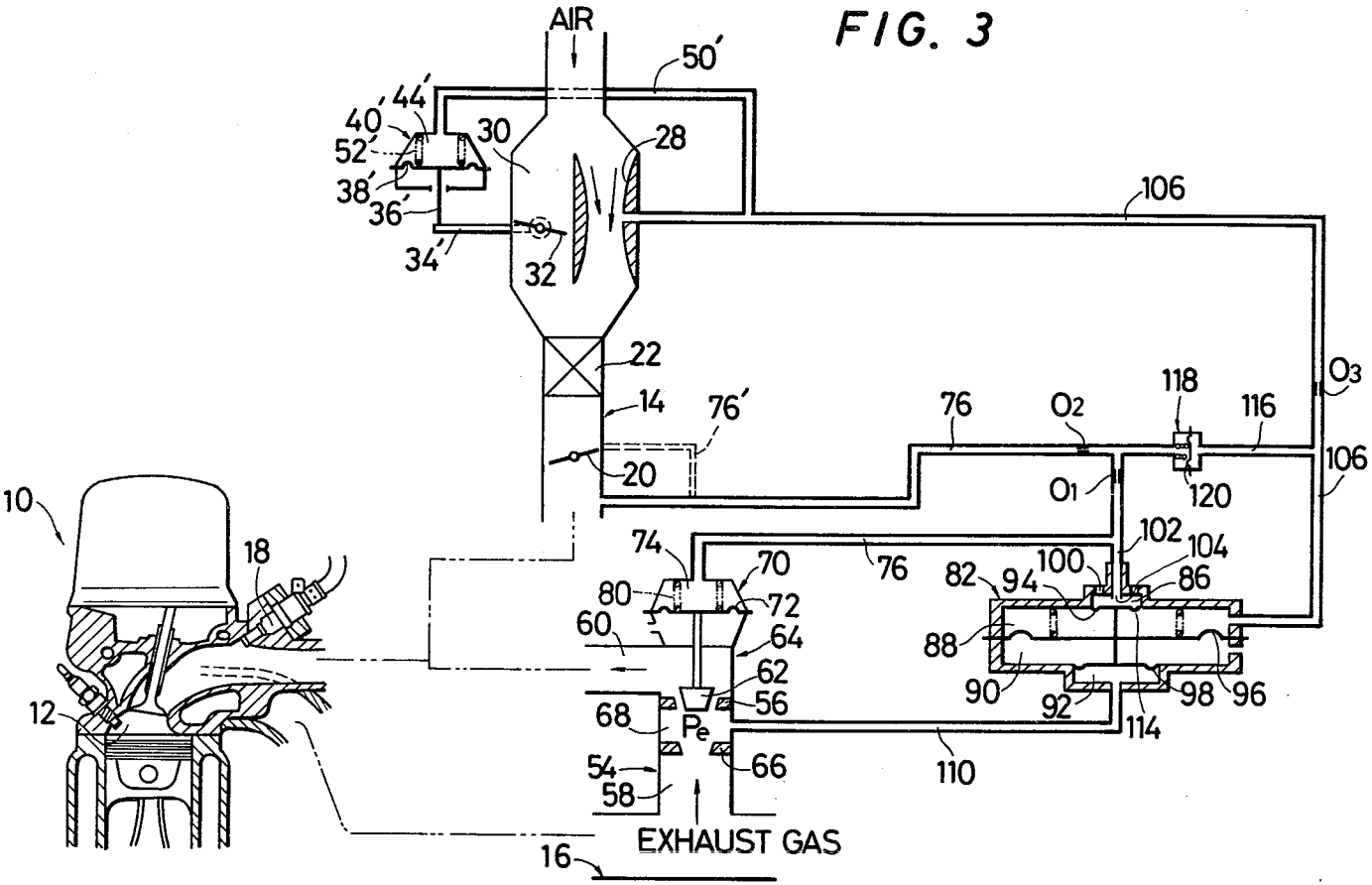
FIG. 3 is a schematic illustration similar to that of FIG. 1, but shows another preferred embodiment of the EGR control system in accordance with the present invention.

FIG. 3 illustrates another preferred embodiment of the EGR control system according to the present invention, which is essentially similar to the embodiment of FIG. 1 with an exception that the valve 32 is arranged to open or close the bypass passage 30 in accordance with the venturi vacuum generated at the venturi 28 formed in the intake passageway. Accordingly, like numerals are assigned to corresponding parts and elements for the purpose of simplicity of description.

In this embodiment, the butterfly valve 32 is rotatably disposed in the bypass passage 30 formed in the intake passageway 14. The valve 32 is mechanically and operatively connected through a lever 34' and a rod 36' to a diaphragm member 38' forming part of a diaphragm actuator 40'. The diaphragm 38' defines a vacuum chamber 44' which communicates through a passage 50' with the passage 106 which is communicated with the venturi 28. A spring 52' is disposed in the vacuum chamber 44' to normally urge the diaphragm member 38' downward in the drawing to put the butterfly valve 32 into its closed position as shown in FIG. 3.

With the above-mentioned arrangement, under low and medium load engine operating conditions, the venturi vacuum at the venturi 28 is relatively low and therefore the diaphragm member 38' is in its lower most position to put the butterfly valve 32 into its closed position as shown in FIG. 3. On the contrary, under high load and high speed engine operating condition, the venturi vacuum at the venturi 28 is increased and exceeds a predetermined level such as 200 mmAq. Then, the diaphragm member 38' is moved upwardly against the bias of the spring 52' to rotate the butterfly valve 32 into its open position. As a result, the bypass passage 30 is opened to allow the intake air to pass through both the venturi 28 and the bypass passage 30.

As apparent from the foregoing description, also in the embodiment of FIG. 3, the amount of the recirculated exhaust gases is accurately controlled in accordance with the flow amount of the intake air under low load and medium load engine operating conditions, while the flow resistance of the intake air can be decreased under high load engine engine operating condition.

Figure 4:
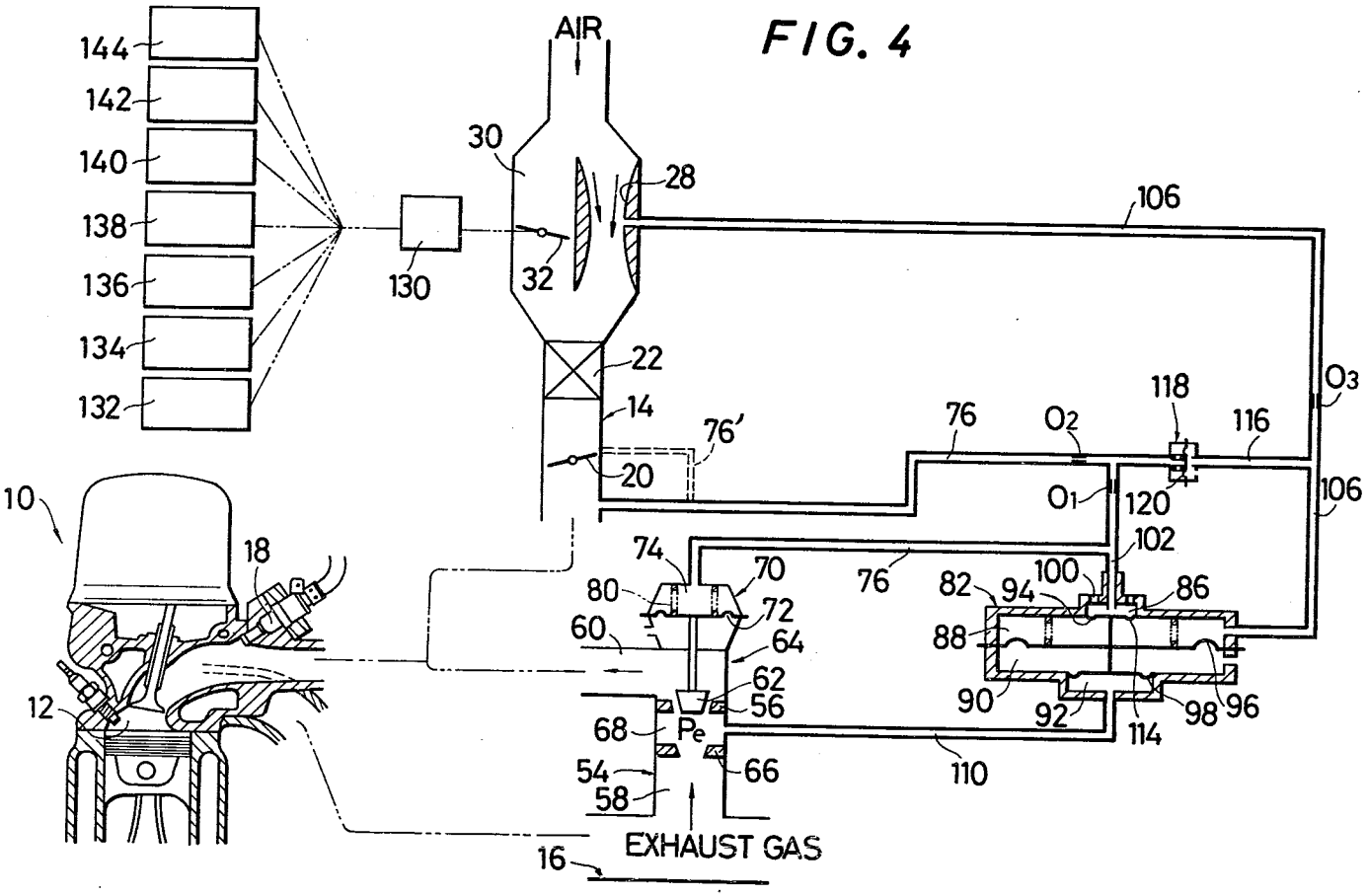
FIG. 4 is a schematic illustration similar to that of FIG. 1, but shows a further preferred embodiment of the EGR control system in accordance with the present invention.

FIG. 4 illustrates a further embodiment of the EGR control system in accordance with the present invention, which is essentially similar to the embodiments of FIGS. 1 and 3 but the valve 32 for opening or closing the bypass passage 30 is operated in accordance with one of the other various engine operating parameters. Also in this embodiment, like reference numeral designate like parts and elements.

As shown, the butterfly valve 32 is operatively connected to an actuator 130 or means for actuating the butterfly valve 32 in response to one of various engine operating parameters. Therefore, the device 130 is connected to a throttle position sensor 132 for sensing the opening degree of the throttle valve 20, in which the device 130 is arranged to open the valve 32 when the opening degree of the throttle valve 20 reaches a predetermined level such as 20°. The device 130 may be connected to an engine speed sensor 134 for sensing the engine speeds of the engine 10, at which the device 130 is arranged to open the butterfly valve 32 when the engine speed reaches a predetermined level such as 2000 rpm. The device 130 may be connected to an exhaust gas pressure sensor 136 for sensing the exhaust pressure in the exhaust gas passageway 16, in which the device 130 is arranged to open the valve 32 when the exhaust gas pressure in the exhaust gas passageway 16 reaches a predetermined level such as 30 mmAq. The device 130 may be connected to an airflow meter position sensor 138 for sensing the opening degree of the measuring plate 24 of the above-mentioned airflow meter 22 shown in FIG. 2, in which the device 130 is arranged to open the butterfly valve 32 when the opening degree of the measuring plate of the airflow meter reaches a predetermined level such as 45°. The device 130 may be connected to a vacuum sensor 140 for sensing the intake vacuum in the intake passageway 14 between the airflow meter 22 and the throttle valve 20, in which the device 130 is arranged to open the butterfly valve 32 when the intake vacuum in the intake passageway 14 between the airflow meter 22 and the throttle valve 20 reaches a predetermined level such as 60 mmAq. The device 130 may be connected to an injected fuel sensor 142 for sensing the amount of fuel injected from the fuel injector 18, in which the device 130 is arranged to open the butterfly valve 32 when the fuel amount injected from the injector 18 reaches to a predetermined level such as 0.5 cc/sec. The device 130 may be connected to an exhaust gas pressure sensor 144 for sensing the exhaust gas pressure $P_e$ in the chamber 68 in the EGR passageway 54, in which the device 130 is arranged to open the butterfly valve 32 when the exhaust gas pressure $P_e$ in the chamber 68 reaches a predetermined level such as 80 mmHg. While above-mentioned various sensors have been shown to be connected all together to the device 130 in FIG. 4, it will be understood that the connection of only one sensor to the device 130 is sufficient to attain the purpose of the present invention.

While the above-described preferred embodiments have been employed, as the valve means 32, only the butterfly valve which opens or closes the bypass passage 30 gradually and continuously, it is to be understood that the valve means 32 may be of the type in which its movable valve member opens or closes the bypass passage 30 in ON-OFF manner.

It is to be noted that the venturi 28 is preferably formed in the intake passageway 14 upstream of the air flow meter 22. Because, if the venturi 28 is formed downstream of the airflow meter 22, the pressure drop due to the flow resistance by the airflow meter 22 is composed with the venturi vacuum at the venturi 28 and accordingly the absolute value of the venturi vacuum becomes larger than that corresponding to the actual flow amount of the intake air. Additionally, the vacuum due to the above-mentioned pressure drop is varied in accordance with the flow amount of the intake air. Consequently, the venturi vacuum is not reliable as a function of the flow amount of the intake air when the venturi 28 is formed downstream of the air flow meter 22.

What is claimed is:

1. An exhaust gas recirculation (EGR) control system in combination with an internal combustion engine including an intake passageway providing communication between the atmosphere and the combustion chamber of the engine, a throttle valve rotatably disposed in the intake passageway, an exhaust gas passageway providing communication between the combustion chamber and the atmosphere, and an electronically controlled fuel injection system having a fuel injector disposed in the exhaust gas passageway downstream of the throttle valve, said EGR system comprising:

a venturi formed in the intake passageway upstream of the throttle valve;

bypass passage means providing communication between portions of the intake passageway upstream and downstream of said venturi;

valve means for opening and closing said bypass passage means in accordance with an engine operating parameter;

EGR passageway means providing communication between the exhaust gas passageway and the intake passageway to recirculate exhaust gases back to the combustion chamber;

a diaphragm actuated EGR control valve operatively disposed in said EGR passageway means to separate said EGR passageway means into an upstream portion connecting to the exhaust gas passageway and a downstream portion connecting to the intake passageway, said EGR control valve being operable in opposite directions to increase and decrease the pressure of the exhaust gases in the upstream portion of said EGR passageway means to control the flow of the recirculated exhaust gases, the diaphragm of the EGR control valve defining a first chamber which communicates through first passage means with the intake passageway to provide the first chamber with an intake vacuum in the intake passageway;

control means for controlling the intake vacuum provided to the first chamber of said EGR control valve to increase and decrease the exhaust gas pressure in the upstream portion of said EGR passageway means in accordance with a decrease and an increase in the exhaust gas pressure in the upstream portion, respectively, and in accordance with a decrease and an increase in a venturi vacuum in said venturi, respectively.

2. An EGR control system as claimed in claim 1, in which said valve means includes a valve member operatively disposed in said bypass passage means to open and close said bypass passage means when opened and closed, respectively, and valve operating means for operating said valve member in accordance with the engine operating parameter.

3. An EGR control system as claimed in claim 2, in which said valve operating means is means for operating said valve member in accordance with the intake vacuum downstream of the throttle valve, said valve member being arranged to open said bypass passage means when the intake vacuum downstream of the throttle valve is below a predetermined level.

4. An EGR control system as claimed in claim 3, in which said valve member is a butterfly valve rotatably disposed in said bypass passage means, and said valve operating means includes a diaphragm actuator having a diaphragm, said diaphragm defining a vacuum chamber which communicates with the intake passageway downstream of the throttle valve.

5. An EGR control system as claimed in claim 2, in which said valve operating means is means for operating said valve member in accordance with the venturi vacuum in said venturi, said valve member being arranged to open said bypass passage means when the venturi vacuum exceeds a predetermined level.

6. An EGR control system as claimed in claim 5, in which said valve member is a butterfly valve rotatably disposed in said bypass passage means, and said valve operating means includes a diaphragm actuator having a diaphragm, said diaphragm defining a vacuum chamber which communicates with said venturi.

7. An EGR control system as claimed in claim 2, in which said valve operating means is means for operating said valve member in accordance with the opening degree of the throttle valve.

8. An EGR control system as claimed in claim 7, in which the operating means is arranged to open the valve member when the opening degree of the throttle valve reaches to a predetermined level.

9. An EGR control system as claimed in claim 2, in which said valve operating means is means for operating to said valve member in accordance with the engine speeds of the engine.

10. An EGR control system as claimed in claim 9, in which the operating means is arranged to open said valve member when the engine speed reaches to a predetermined level.

11. An EGR control system as claimed in claim 2, in which said valve operating means is means for operating said valve member in accordance with the exhaust gas pressure in the exhaust gas passageway.

12. An EGR control system as claimed in claim 11, in which the operating means is arranged to open said valve member when the exhaust gas pressure in the exhaust gas passageway reaches a predetermined level.

13. An EGR control system as claimed in claim 2, in which said valve operating means includes means for operating said valve member in accordance with the opening degree of the measuring plate of an airflow meter disposed in the intake passageway.

14. An EGR control system as claimed in claim 13, in which the operating means is arranged to open said valve member when the opening degree of the measuring plate reaches a predetermined level.

15. An EGR control system as claimed in claim 13, in which said airflow meter is located downstream of said venturi.

16. An EGR control system as claimed in claim 2, in which said valve operating means is means for operating said valve member in accordance with the intake vacuum in the intake passageway between said airflow meter and throttle valve.

17. An EGR control system as claimed in claim 16, in which the operating means is arranged to open said valve member when the intake vacuum in the intake passageway between said airflow meter and the throttle valve reaches a predetermined level.

18. An EGR control system as claimed in claim 2, in which said valve operating means is means for operating said valve member in accordance with the amount of the fuel injected from a fuel injector of a fuel injection system, the injector being disposed to open in the intake passageway downstream of the throttle valve.

19. An EGR control system as claimed in claim 18, in which the operating means is arranged to open said valve member when the amount of the injected fuel from said fuel injector reaches a predetermined level.

20. An EGR control system as claimed in claim 2, in which said valve operating means is means for operating said valve member in accordance with the exhaust gas pressure in the downstream portion of said EGR passageway means.

21. An EGR control system as claimed in claim 20, in which the operating means is arranged to open said valve member when the exhaust gas pressure in the downstream portion of said EGR passageway means reaches a predetermined level.

22. An EGR control system as claimed in claim 1, in which said control means comprises second passage means connecting to said first passage means and having an inlet port communicating with the atmosphere for bleeding atmospheric air into said second passage means to dilute the vacuum in said first chamber, a pressure regulating valve located with a head movably relative to said inlet port of said passage means for controlling the flow of atmospheric air bled through said inlet port into said second passage means, and operating means operatively connected to said pressure regulating valve so that said pressue regulating valve reduces and increases the bleed of atmospheric air through said inlet port in response to an increase and a decrease in said venturi vacuum, respectively and in response to an increase and a decrease in the exhaust gas pressure in the upstream portion of said EGR passageway means to reduce and increase the dilution of the intake vacuum provided to said first chamber respectively.

23. An EGR control system as claimed in claim 22, in which said operating means comprises a first flexible diaphragm defining a second chamber communicating with said venturi through a third passage means to receive said venturi vacuum therefrom; and a second flexible disphragm defining a third chamber communicating with the upstream portion of EGR passageway means to receive the exhaust gas pressure therefrom, said second flexible diaphragm being fixedly connected to said first diaphragm, said first and second diaphragms being operatively connected to said pressure regulating valve so that said pressure regulating valve is operated to reduce and increase the flow of atmospheric air through said inlet port in response to an increase and a decrease in said venturi vacuum provided in said second chamber, respectively, and in response to an increase and a decrease in the exhaust gas pressure provided in said third chamber, respectively.

24. An EGR control system as claimed in claim 23, further comprising a relief valve means for bleeding air into the second chamber of said operating means when the composed vacuum of the intake vacuum in said intake passageway and the vacuum in said first chamber exceeds a predetermined level representing a high speed and low load engine operation.

25. An EGR control system as claimed in claim 24, in which said relief valve means includes a fourth passage means connecting said third passage means and said first passage means of the intake passageway side of the junction to which said second passage means is connected, a relief valve disposed in said fourth passage means and having a diaphragm valve member dividing the interior of the casing thereof into a vacuum chamber communicating with the first passage means and an atmospheric chamber communicating with the third passage means and with the atmosphere, an open end portion connecting to the fourth passage means on the third passage means side, said open end portion being secured to a portion of the casing defining the atompsheric chamber, and a spring disposed in said vacuum chamber to normally urge said diaphragm valve member to contact to said open end portion so as to close said open end portion, said spring being arranged to be contracted to separate said diaphragm valve member from said open end portion when the degree of the vacuum applied to said vacuum chamber exceeds said predetermined level.

* * * * *